United States Patent [19]

Martell et al.

[11] Patent Number: 4,509,443

[45] Date of Patent: Apr. 9, 1985

[54] AUTOMATIC SEWING MACHINE AND METHOD FOR JACKET SLEEVE ATTACHMENT

[75] Inventors: Charles R. Martell; Elmer N. Leslie, both of Dallas; Stephen S. Treadwell, Richardson, all of Tex.

[73] Assignee: Microdynamics, Inc., Dallas, Tex.

[21] Appl. No.: 462,568

[22] Filed: Mar. 1, 1983

[51] Int. Cl.[3] ..... D05B 27/08

[52] U.S. Cl. ..... 112/262.1; 112/313; 112/315; 112/320; 112/121.11

[58] Field of Search ..... 112/262.1, 312, 313, 112/314, 315, 320, 121.11, 318, 275, 303, 2

[56] References Cited

U.S. PATENT DOCUMENTS

| | | | |
|---|---|---|---|
| 3,459,145 | 8/1969 | Ramsey et al. . | |
| 3,804,040 | 4/1974 | Arnold . | |
| 3,867,889 | 2/1975 | Conner, Jr. | 112/121.11 |
| 4,069,778 | 1/1978 | Kozawa . | |
| 4,104,976 | 8/1978 | Landau, Jr. et al. | 112/275 X |
| 4,130,073 | 12/1978 | Kimura et al. . | |
| 4,201,145 | 5/1980 | Blessing | 112/318 X |
| 4,359,953 | 11/1982 | Martell et al. . | |
| 4,363,281 | 12/1982 | Reinke | 112/121.11 |
| 4,377,122 | 3/1983 | Boser et al. | 112/318 X |
| 4,412,498 | 11/1983 | Scholl | 112/313 |

OTHER PUBLICATIONS

Pfaff, Model 3801, Article Entitled "Integrated Sewing Station For The Programmed Working in of Fullness".
Tecmic, Model LS3-M202 "Super Quality Sleeve Setting with Unskilled Help".
Eagle Model E-2011, "Sleeve Setting Machine".
Brother, BAS-150, "Automatic Sleeve Easing Machine".
Adler, 550-16-1, "Programmed Insertion of Sleeves".

*Primary Examiner*—Peter Nerbun
*Attorney, Agent, or Firm*—Jerry W. Mills; Gregory M. Howison; Nina L. Medlock

[57] ABSTRACT

The present invention includes a sewing machine (12) with a variable top feed mechanism (25) that feeds the top layer of material for a sleeve at a variable rate to change the fullness thereof. The machine (12) is driven by a motor (42) which is controlled by a controller (51). A program is taught to the controller (51) for storage therein. The controller (51) then controls both the motor (42) and a controller (45) for the top feed mechanism to regulate the number of stitches and the relative rates of speed for the top and bottom materials fed by the machine. The program initially is taught to the machine and can be utilized for any type of material or size by inputting the correct sizes and types of material on a control panel (44). The machine (12) therefore semi-automatically sews sleeves onto armholes with the correct fullness sewn therein.

11 Claims, 10 Drawing Figures

FIG. 1
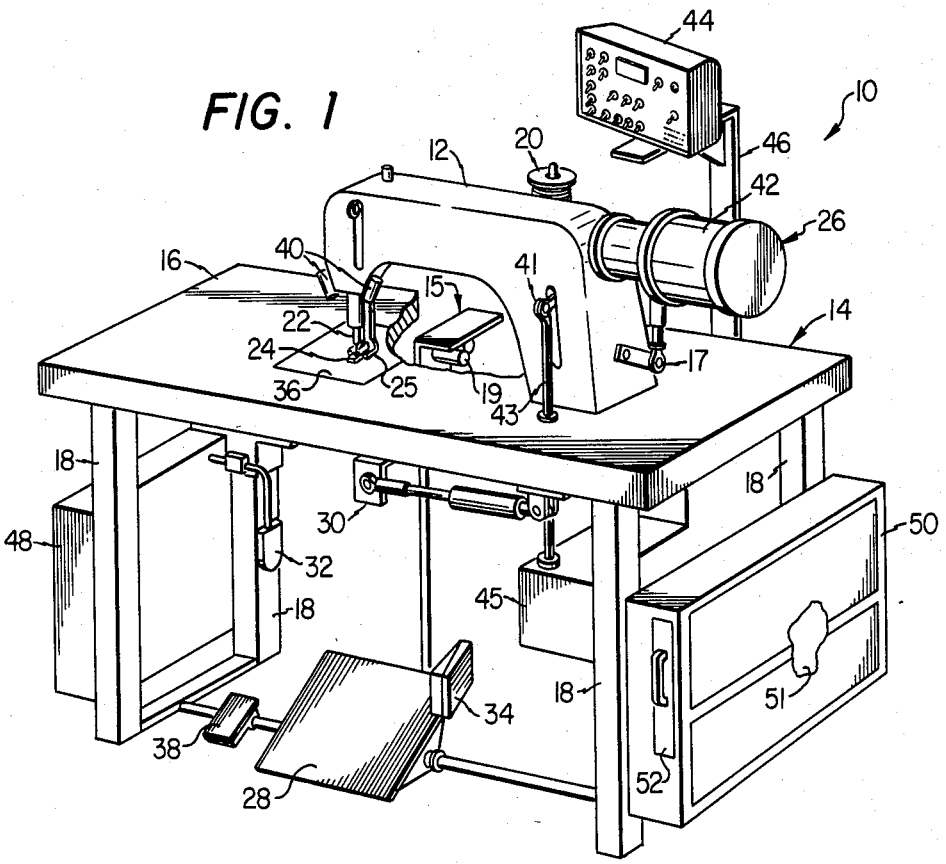
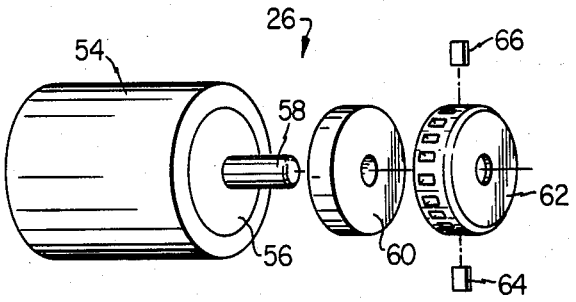
FIG. 2

FIG. 3
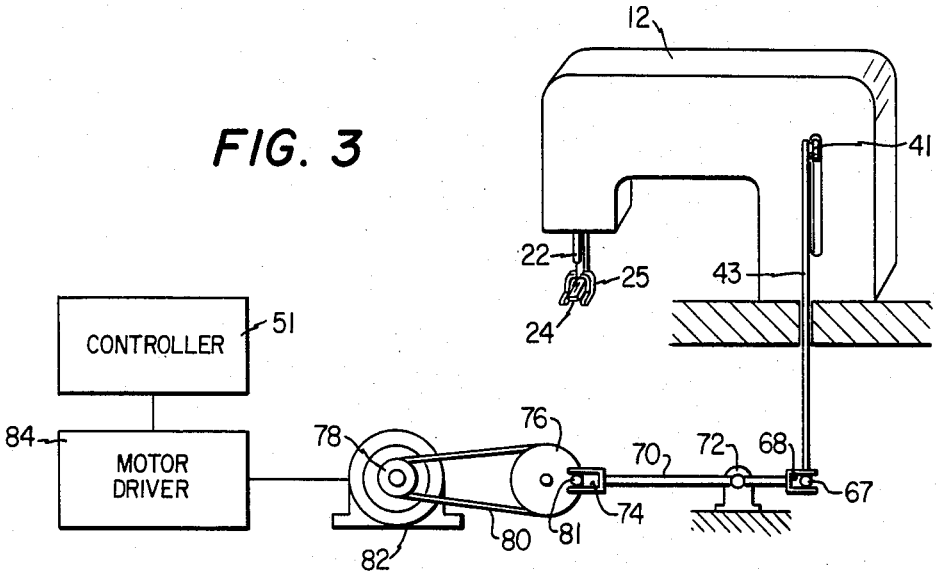
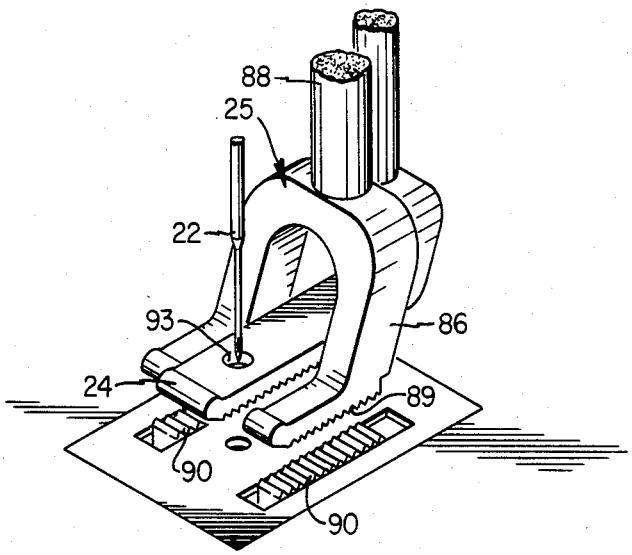
FIG. 4

FIG. 5a
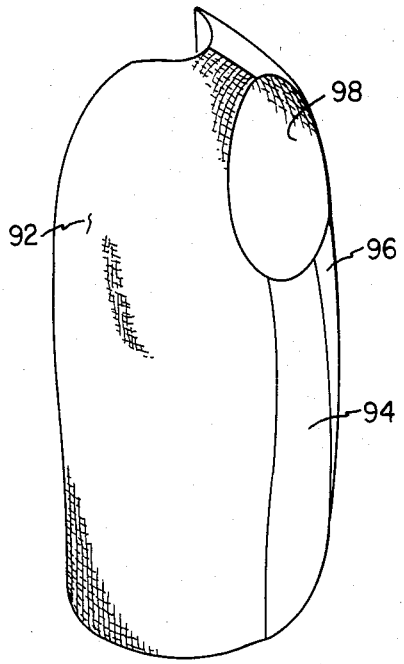
FIG. 5b
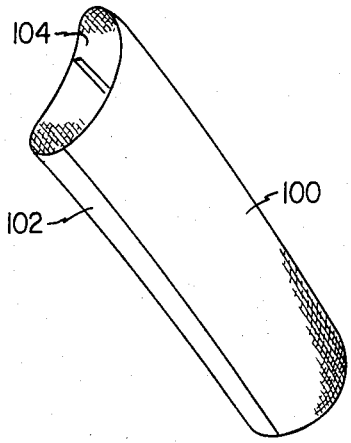
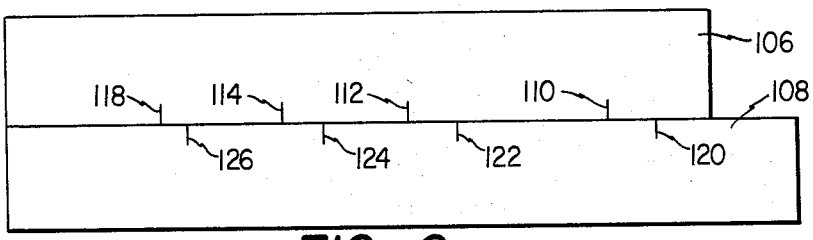
FIG. 6a
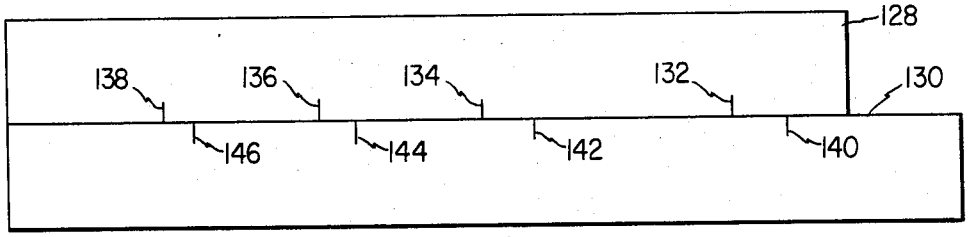
FIG. 6b

AUTOMATIC SEWING MACHINE AND METHOD FOR JACKET SLEEVE ATTACHMENT

TECHNICAL FIELD

This invention pertains in general to automatic sewing machines and, more particularly, to sewing machines having variable top and bottom feeds for automatically adjusting the sleeve fullness distribution in the jacket sleeve set operation.

BACKGROUND OF THE INVENTION

Jacket sleeves typically consist of two parts—a top sleeve and an under sleeve. After the top sleeve and the under sleeve are assembled and joined, the sleeve forms a tube. The end of the sleeve is designed such that it is not perpendicular to the center line of the tube. This sleeve is then mated to an armhole on a jacket. The armhole itself is created by the assembly of three parts—the back, front and side body. The resulting armhole opening is slightly more eggshaped than round. Normally, alignment notches are located on the periphery of the armhole opening and the end of the sleeve. These alignment notches are utilized during the sleeve setting operation to assure the proper orientation of the sleeve with respect to the armhole and also to assist the operator in distributing the excessive "fullness" in the sleeve as it is set into the armhole. Suitable fullness is required to provide a visually satisfactory style, as well as desirable fit to allow arm movement. Fullness is determined by the relative length of material around the periphery of the sleeve opening that is matched with the length of material around the armhole. For example, the distance between two notches on the armhole can be spaced at approximately two inches whereas the distance between two mating notches on the sleeve may be 2.5 inches. This results in fullness due to a longer length of sleeve material being matched to a corresponding length of armhole material.

Because of styling and fit considerations, the fullness distribution of the sleeve with respect to the armhole is not uniform along the entire periphery of the armhole. For example, more sleeve fullness is required at the top of the shoulder to allow the sleeve to "roll over" and hang properly. Likewise, no sleeve fullness is required across the bottom of the armhole for comfort reasons. In addition, there must be no localized discontinuities in the fullness distribution since this will result in "dimples" or "pinch marks" on the periphery of the sleeve. Therefore, it is very important that the operator control the fullness distribution on a localized as well as an overall basis, such that the sleeve hangs at the proper angle, the roll in the sleeve is aesthetically pleasing and there are no localized discontinuities which distract from the appearance of the garment.

Sewing machine manufacturers have developed machines which have a variable top feed mechanism in order to handle sewing operations which require fullness of one material ply relative to the other ply. These machines have independent feeding mechanisms to feed the bottom and top plies of material such that the distance the feeding mechanism advances for each stitch can be adjusted independently for the bottom and top feed mechanisms. Thus, if fullness is required in the top ply of the material, the top feed mechanism is adjusted to advance a greater distance than the bottom feed mechanism during the stitch formation. If no fullness is required, the top and bottom feed mechanisms are set to advance the same distance during the stitch formation. Finally, the top feed mechanism can be adjusted to advance less than the bottom feed during stitch formation if it is desirable to sew fullness in the bottom ply material.

When a sewing machine operator is setting a jacket sleeve, the top feed mechanism must be varied in order to produce the fullness distribution desired. In the past, different techniques have been employed to vary the top feed mechanism as the sleeve is being set. One technique is to utilize a foot treadle which is mechanically linked to the top feed mechanism. As the operator sews the part, she depresses the foot treadle to advance or retard the top feed mechanism in order to provide the proper amount of fullness. Since the sleeve part is sewn as the top ply material, and it is desirable to sew in excess fullness in the sleeve relative to the armhole, the top feed mechanism is set to give equal or more than equal feed on the top ply. Additional enhancements have been made to variable top feed machines by adding optical scales and/or gauges which graphically illustrate to the operator the amount of top ply that is currently being sewn relative to the bottom ply. For example, a Durkopp 541 sewing machine has a fish scale type mechanism which advances a pointer from 0 to 9, as the top feed mechanism is advanced from no top feed to maximum top feed by depression of the foot treadle. In a similar manner, the Pfaff 337 sewing machine utilizes a set of five indicator lights which are arranged in a vertical orientation. As the operator depresses the foot treadle to increase the top feed from no top feed to maximum top feed, the lights are progressively lit.

In the more advanced mechanisms that have been developed, a cam is utilized to control the top feed mechanism as the sleeve is set. This cam mechanism is mechanically linked to the top feed mechanism by way of a cam follower which rides on the cam which is rotated one complete revolution during the sewing operation. An example of this type of mechanism is the Tecmics model LS3-302 sewing machine with optional accessory model 1KD.

Recently, microprocessors have been used to facilitate the storage of a series of top feed values which can be easily requested by the operator as the operation is being performed. For example, the Adler model 550-16-1 sewing machine has the capability to store top feed values with each value in the range of 0 to 9 representing 0% to 100% top feed. As the sleeve is being set, the operator activates a switch which causes a stepper motor to adjust the top feed mechanism to the next stored value.

Although the above described systems deskill the operation and improve quality to a varying degree, they have not solved the overall problem of accurately controlling the top feed mechanism when sleeves are set. In view of these deficiencies, there exists a need for a system which automatically controls the top feed to compensate for differences in size, material type, material bias and sewing direction during the sleeve set operation.

SUMMARY OF THE INVENTION

The invention disclosed and claimed herein comprises a method and apparatus for semi-automatically sewing two pieces of material with a specified fullness distribution. The apparatus includes a device for sensing the stitch count. A predetermined profile of the desired fullness distribution is stored into the sewing machine and accessed to adjust the relative feed rate of the two pieces of material as a function of the stitch count to conform to the profile and to produce the desired fullness distribution.

In another embodiment of the present invention, the predetermined profile is taught to the machine by manually sewing one part. This profile is then stored as a generic profile for a given style which can be modified by changing parameters such as size material type.

BRIEF DESCRIPTION OF THE DRAWINGS

For a more complete understanding of the present invention and the advantages thereof, reference is now made to the following description taken in conjunction with the accompanying drawings in which:

FIG. 1 illustrates a perspective view of an automatic sewing machine;

FIG. 2 illustrates an exploded view of the driving mechanism and sensors;

FIG. 3 illustrates a schematic diagram of the top feed mechanism and driving controls therefore;

FIG. 4 illustrates a perspective view of the top feed mechanism;

FIG. 5*a* illustrates a perspective view of the body portion of a jacket without the sleeve attached;

FIG. 5*b* illustrates a perspective view of the sleeve;

FIGS. 6*a* and 6*b* illustrate a planar view of a strip portion of the armhole and sleeve for two sizes;

DETAILED DESCRIPTION OF THE INVENTION

Figure 7:
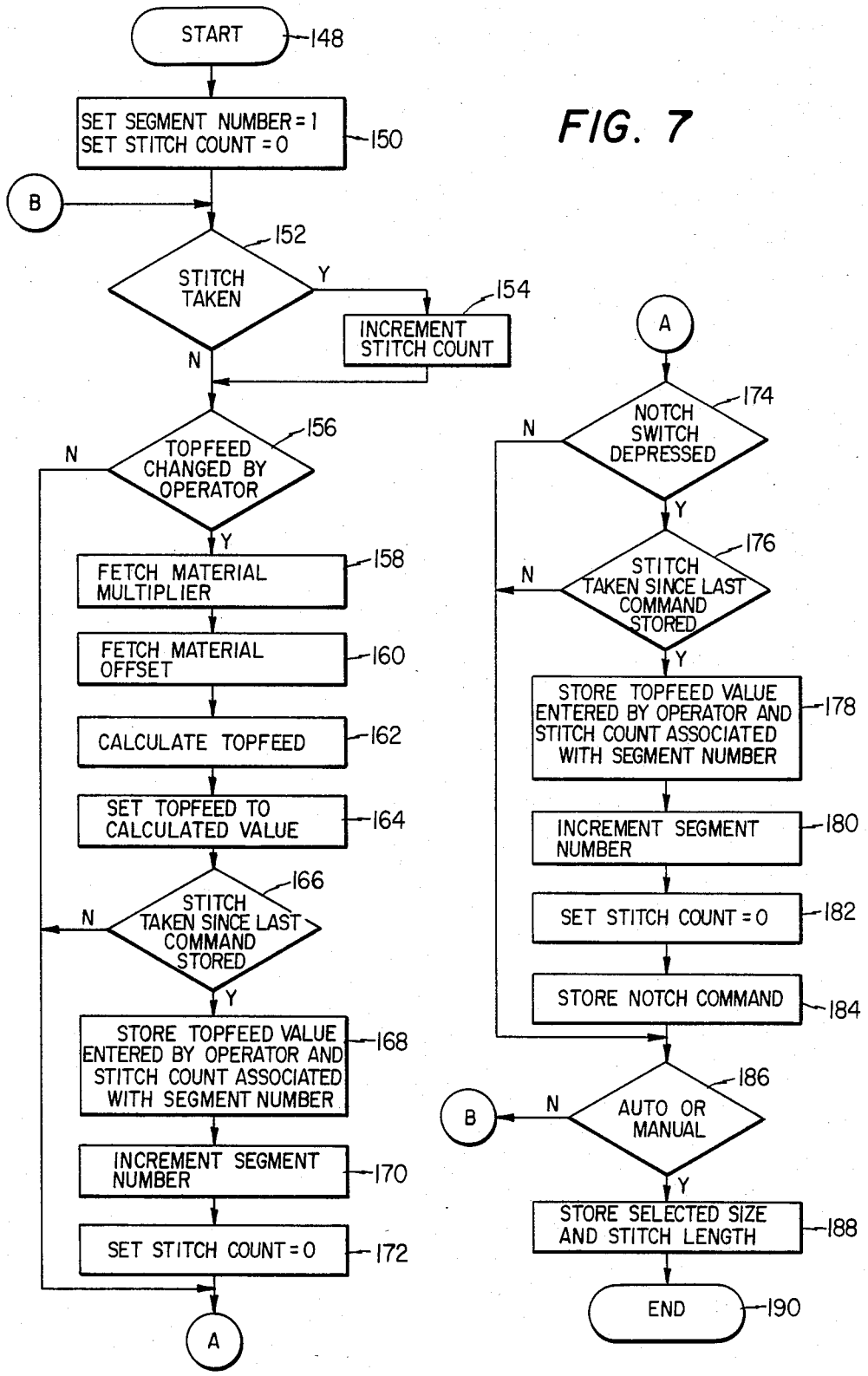
FIG. 7 illustrates a flow diagram for the teach mode of the present invention.

Referring now to FIG. 1, there is illustrated a perspective view of a semi-automatic sewing system 10 incorporating the invention. System 10 is a microprocessor-based system which extends the capabilities of a sewing machine by enabling the operator to perform sewing procedures on a manual or semiautomatic basis, as will be more fully explained hereinafter.

System 10 includes a conventional sewing machine 12 mounted on a work stand 14 consisting of a table top 16 supported by four legs 18. Sewing machine 12, which is of conventional construction, includes a spool 20 containing a supply of thread for stitching by a reciprocating needle 22 to form a seam in one or more pieces of material. Surrounding the needle 22 is a vertically movable presser foot 24 for cooperation with a lower feed dog (not shown) and an upper feed dog 25 shown surrounding the presser foot 24. The upper and lower feed dogs are used for feeding both a lower layer of material and an upper layer of material past the needle 22, as will be described hereinbelow.

A number of standard controls are associated with the sewing machine 12 for use by the operator in controlling its function. A handwheel 26 is attached to the drive shaft (not shown) of the machine 12 for manually positioning the needle 22 in the desired vertical position. The sewing speed is controlled by a speed sensor 15 that is actuated by a foot pedal 28, which functions like an accelerator. Vertical positioning of the presser foot 24 can be controlled by heel pressure on the foot pedal 28 which closes a switch 19 and the speed sensor 15, which in turn causes a presser foot lift actuator 30 to operate. A leg switch 32 is provided for controlling the sewing direction of the machine 12 by causing operation of a reverse sew lever actuator 17. A toe switch 34 located adjacent to the foot pedal 28 controls a conventional thread trimmer (not shown) disposed underneath a toe plate 36 on machine 12. A foot switch 38 on the other side of the foot pedal 28 comprises a one-stitch commanding the machine 12 to sew a single stitch.

It will thus be understood that the sewing machine 12 and its associated manual controls are of substantially conventional construction, and may be obtained from several commercial sources. For example, suitable sewing machines are available from Singer, Union Special, Pfaff, Consew, Juki, Columbia, Brother and Durkopp Companies.

In addition to the basic sewing machine 12 and its manual controls, the system 10 also includes an upper feed dog 25 that surrounds the presser foot 24 thereby allowing the upper layer of material to be fed at a different rate than the lower piece of material. The distance the upper feed dog moves for each stitch is controlled by a lever 41 attached to a reciprocating rod 43 that is driven by a control unit 45. An example of a machine having an upper feed dog is model number 337 manufactured by Pfaff or model number 541 manufactured by Durkopp.

A drive unit 42 comprising a variable speed direct drive motor is attached to the drive shaft of the sewing machine 12. A main control panel 44 supported on a bracket 46 is provided above one corner of the work stand 14. The control panel 44 has various switches disposed on the surface thereof in addition to a keypad for entering data, such as a conventional telephone keypad. From one side of the work stand 14 there is a pneumatic control chassis 48 containing an air regulator, filter and lubricator for the sewing machine control sensors, pneumatic actuators and other elements of the system 10. All these components are of known construction and are similar to those shown in U.S. Pat. Nos. 4,359,953; 4,108,090; 4,104,976; 4,100,865 and 4,092,937, the disclosures of which are incorporated herein by reference.

A controller chassis 50 is located on the opposite side of the work stand 14 for housing the electronic components of the system 10. Chassis 50 includes a microprocessor controller 51, appropriate circuitry for receiving signals from sensors and carrying control signals to actuators, and a power module for providing electrical power at the proper voltage level to the various elements of system 10. The microprocessor controller 51 may comprises a Zilog model Z-80 microprocessor or any suitable unit having a read only memory (ROM) and a random access memory (RAM) of adequate storage capacities. The controller 51 is programmed in accordance with the present invention to provide a predetermined profile for the sewing operation. An auxiliary panel 52 is mounted for sliding movement on one end of the chassis 50. In addition to the RAM, there is also provided a cassette storage as an off line storage (not shown). These storage devices provide mass storage capability that is non-volatile for storing machine instructions for the controller 51.

Referring now to FIG. 2, there is illustrated an exploded perspective view of the drive unit 42 of FIG. 1 and the system 10. The drive unit 42 includes a housing 54 enclosing a variable speed drive motor 56 having a drive shaft 58 coupled directly to the drive shaft of the sewing machine 12. An electromagnetic brake 60 is secured to the shaft 58 as are a sensor vane 62 and the handwheel 26; of which the handwheel has been omitted from FIG. 2 for clarity. The sensor vane 62 includes a plurality of uniformly spaced openings therearound which cooperate with sensor 64 and 66 to provide an indication to the microprocessor controller 51 of the angle in the sewing cycle at which the shaft 58 is positioned. In addition, the sensors 64 and 66 also provide an indication to the microprocessor controller 51 of the number of revolutions that the motor has progressed which directly corresponds to the number of stitches sewn.

As illustrated, the sensor vane 62 includes 36 evenly circumferentially spaced openings therein to achieve a resolution of 10° rotation. A sensor 64 provides a reference or a sync signal against which the motor angle signals received from the sensor 66 are compared within the microprocessor controller 51 to fix the angular position in the sewing machine cycle, thus providing a reference for the microprocessor 51 to sense the motor angle and the revolutions of the motor. With the sensors 64 and 66, the microprocessor controller can determine each 10% incremental rotation of the motor shaft 58.

Any suitable interrupt type sensors can be utilized for the sensors 64 and 66. For example, a model TIL 147 photo-optical sensor from Texas Instruments, Inc. can be used for sensor 66. A model TL 172C Hall effect sensor from Texas Instruments, Inc. can be utilized for sensor 64.

Referring now to FIG. 3, there is illustrated a schematic diagram of the variable top feed mechanism for driving the upper feed dog 25. The lower end of the reciprocating rod 43 has a sliding pin 67 mounted thereon and perpendicular thereto which is slideably inserted into a slot 68 disposed on one end of an oscillating beam 70. The oscillating beam 70 is pivotally mounted on a bracket 72 and has a slot 74 disposed on the opposite end of the oscillating beam 70 from the slot 68. A driven pulley 76 is connected to a driving pulley 78 by a driving belt 80 and is co-rotatable therewith. The driven pulley 76 has a pin mounted on the periphery thereof and slideably inserted into the slot 74.

The driving pulley 78 is mounted on the drive shaft of a reversible stepper motor 82 and is co-rotatable therewith. The stepper motor 82 is driven by stepper motor driver electronics for converting output control signals from the controller 51 to suitable driving signals for the stepper motor 82. Rotation of the stepper motor 82 causes a corresponding rotation of the driven pulley 76. As the driven pulley 76 rotates in a clockwise direction, the pin 81 causes the oscillating beam 70 to rotate in a counterclockwise direction about the pivoting point on the bracket 72. This clockwise rotation causes the pin 67 to impart an upward motion onto the reciprocating rod 43. Reversal of the stepper motor 82 causes the driven pulley 76 to rotate in a counterclockwise direction thereby imparting a clockwise rotation onto the oscillating beam 70 which is translated into a downward force on the reciprocating rod 43. The reciprocation of the rod 43 imparts a corresponding reciprocation onto the lever 41. The amount of feed per each stroke of the upper feed dog 25 directly corresponds to the vertical position of the reciprocating rod 43. This position is directly controlled by the amount of rotation of the stepper motor 82. By varying the amount of rotation of the stepper motor 82 in either direction, the amount of material fed per each stroke of the upper feed dog 25 can be controlled, thereby providing a variable feed mechanism.

Referring now to FIG. 4, there is illustrated a detailed view of the upper feed dog mechanism 25. The upper feed dog mechanism 25 is comprised of a forked member 86 mounted on a shaft 88. The forked member 86 is disposed about the presser foot 24 and has serrated edges 89 on the bottom thereof. The presser foot 24 also has serrated edges 91 on the bottom edge thereof. The needle 22 is inserted through a slot 93 in the presser foot 24.

In operation, the upper feed dog 25 and the presser foot 24 operate in unison with each other. That is, the upper feed dog 25 is raised when the presser foot 24 is lowered and the presser foot 24 is raised when the upper feed dog 25 is lowered. In this manner, the material (not shown) is held against a lower feed dog 90 when the upper feed dog 25 is raised. When the upper feed dog 25 is lowered, the presser foot 24 is raised such that no restriction is imposed upon the upper layer of material. However, the presser foot 25 restricts movement of the top ply of material as a function of movement of the bottom ply of material (not shown).

Referring now to FIGS. 5*a* and 5*b*, there is illustrated the assembled portions of the body and the sleeve assembly. The body assembly of FIG. 5*a* is comprised of a front panel 92, a side panel 94 and a back panel 96. When assembled, the body parts 92–96 form an armhole 98. The sleeve as shown in FIG. 5*b* is comprised of an upper panel 100 and a lower panel 102. The assembled sleeve is configured as a tube having a sleeve opening 104 for mating with the armhole 98 of the body assembly of FIG. 5*a*. As will be apparent hereinafter, the sleeve opening 104 and the armhole 98 do not directly correspond, that is, the circumferential distance around the edge of each of the holes 98 and 104 are not equal.

Referring to FIGS. 6*a* and 6*b*, there is illustrated a planar view of segments of the peripheral border of both the armhole 98 and the mating sleeve opening 104. For illustrative purposes, these views are shown disconnected and laid out in a common plane depicting only the borders thereof shown. In FIG. 6*a*, a strip 106 represents the border of the armhole 98 and a longer strip 108 represents the border of the sleeve opening 104. The strips 106 and 108 are shown adjacent each other for illustrative purposes only. The strip 106 has four alignment notches 110–118 disposed along the border thereof and the strip 108 has four alignment notches 120–126 disposed along the border thereof. These notches are present along the periphery of the armhole 98 and the sleeve opening 104, but are omitted in FIGS. 5*a* and 5*b* for clarity. During the sewing operation, it is necessary that the notch 110 align with the notch 120, the notch 112 align with the notch 122, the notch 114 align with the notch 124 and the notch 118 align with the notch 126. In this manner, it is apparent that for each stitch sewn, the strip 108 must be fed at a faster rate than the strip 106 to align the notches. This results in the strip 108 having more "fullness" than the strip 106.

Referring now to FIG. 6*b*, there is illustrated a strip 128 disposed adjacent a longer strip 130. The strip 128 corresponds to the border of the armhole 98 and the strip 130 corresponds to the border of the sleeve opening 104. The strips 128 and 130 are similar to the strips 106 and 108 of FIG. 6*a* except that they are longer to illustrate a larger size. Strip 128 has four alignment notches 132–138 disposed along the edge thereof and, in like manner, the strip 130 has four alignment notches 140–146 disposed along its edge. The notches 132–138 align with the corresponding notches 140–146, respectively.

The dimensions of the sleeve opening 104 and the armhole 98 change for different sizes. For example, the sleeve opening 104 and armhole 98 may vary as follows:

| Size | Sleeve (Inches) | Armhole (Inches) | Fullness (Inches) |
|---|---|---|---|
| 46 | 22.6 | 20.8 | 1.8 |
| 50 | 24.1 | 22.3 | 1.8 |
| 54 | 25.4 | 23.6 | 1.8 |
| 58 | 27.0 | 25.2 | 1.8 |

In this example, the total amount of sleeve fullness which must be sewn into the sleeve is 1.8 inches for all sizes, that is, the sleeve which is longer must be fed at a faster rate than the armhole such that when the sewing operation is complete, both ends of the sleeve and armhole match. From this example, it is apparent that the total amount of fullness remains the same while the armhole changes size. Therefore, more fullness per inch sewn is required on smaller sizes than is required on larger sizes in order to sew in the same amount of fullness over a shorter distance. The control system therefore increases or decreases the overall top feed setting to increase or decrease the fullness in order to compensate for size variation. However, it should be understood that for some styles, depending upon the paticular pattern, the variation in fullness may not be constant.

The alignment notches are provided as a guideline for the operator in distributing the fullness of the sleeve and aligning the sleeve to the body. For example, when the sleeve is sewn into the armhole, the operator must align the alignment notches to assure proper sleeve orientation and fullness distribution and the top feed must be varied accordingly. Since the distances between corresponding notches varies according to the size of the parts, it is apparent that more or fewer stitches must be sewn to cover the interval between notches prior to changing the top feed setting for varying sizes. This is more clearly illustrated by an example wherein the strips 106 and 108 of FIG. *6a* represent a size 46 armhole and the strips 128 and 130 of FIG. *6b* represent a size 48 armhole. The interval between the notches 112 and 114 on the size 46 armhole is 3.81 inches while the corresponding interval on the size 48 armhole between notches 134 and 136 is 4.69 inches. The corresponding sleeve dimensions are 4.28 inches between the notches 122 and 124 and 5.16 inches between the notches 142 and 144. On the size 46 armhole of FIG. *6a*, it is necessary to sew approximately an average of 12% top feed to align the notches 112 with 122 and 114 with 124 whereas on the size 48 armhole of FIG. *6b*, only an average of 10% top feed is required to align the notches 134 and 142 and 136 with 144. Therefore, the control system adjusts the top feed value and the stitch count at which the top feed value is changed in order to compensate for size differences. As will be described hereinbelow, the operator "teaches" one size for both the right and left sleeve which is stored as a profile for retrieval during each sewing operation, it should be understood that the only changes made during semi-automatic operation are the input parameters that are input to the controller 51 on the input panel 44.

Although the system stores one profile to define a desired sewing pattern for a reference size, other parameters affect the sewing operation such as the material type. This is because the stitch length produced by the feed mechanism on sewing machines varies for different material types. For example, soft materials on which the feeding mechanism does not slip generally requires a different stitch length than hard materials for which slip can be present. Likewise, materials with irregular construction such as corduroys exhibit irregular feeding characteristics depending on the orientation of the feeding mechanism with respect to the nap and warp (web) direction of the material. Therefore, a top feed value that produces a top feed of 10% in one material may produce a top feed of 8.5% in a second material, 6.2% in a third, and 11.8% in a fourth for a given machine. The system of the present invention varies the top feed in order to compensate for material variances to assure that the same amount of top feed is produced when different materials are sewn. The material type and its relation with a reference material are input to the controller 51 for storage therein to provide a parameter for adjusting the relative top feed for different materials as compared to the standard.

In sewing the right sleeve as compared to sewing the left sleeve, the sewing directions are normally reversed. The right sleeve is started at the front near the bottom of the armhole, sewn along the front part towards the shoulder, over the shoulder and along the back part and under the armhole and back to the starting point. The left sleeve is normally started at a notch on the back and sewn along the back towards the shoulder, over the shoulder and down the front, around the bottom of the armhole and then along the back to the starting point. Since the orientation of the material feeding mechanism on the machine with respect to the nap of the material changes for the left and right sleeve, it is normally necessary to use different top feed value, for the same alignment notch intervals on the left and right sleeves, respectively. The present system provides the capability to control the top feed mechanisms during the settings of the left and right sleeve independently.

Referring now to FIG. 7, there is illustrated a flow chart for the procedure of inputting a predetermined sewing profile for a given sleeve style. The program is initiated by depressing a switch labeled "MANUAL" on the control panel 44 to put the machine into a manual mode of operation. A dial labeled "PROGRAM SELECT" is then set to a value of 1 to 8 corresponding to the style of the jacket. Each different sleeve fullness distribution profile represents a different style and eight different styles can be programmed at one time. A dial labeled "SIZE" is then turned to the correct setting for the size to be sewn, which is the reference size. A dial labeled "MATERIAL" is then set for the material being sewn and then a switch labeled "TEACH" is turned on. At this time the sleeve to be sewn (Right or Left) is also selected by depressing the appropriate switch. This is indicated by a start block 148. The program then proceeds to a function block 150 wherein the segment number is set equal to one and a stitch count is set equal to zero. Since the fullness is determined by the number of stitches taken per each setting of the top feed mechanism, these are termed "segments". By storing this information in RAM, the data can be later retrieved to set the stitch count for each segment. After the parameters are set, the program proceeds to a decision block 152 to decide whether a stitch has been taken. As described above, the encoder for this step is enclosed in the motor 42 to indicate to the controller 51 that one stitch has been taken. If a stitch has been taken, the program proceeds along the "Y" path to a function block 154 wherein the stitch count is incremented. If a stitch has not been taken, the program proceeds along an "N" path from the decision block 152 to the input of a decision block 156. This is also the point where the program flows from the function block 154.

The decision block 156 decides whether the rate of top feed has been changed or altered by the operator. Initially, the operator places the system into the TEACH mode and then depresses the appropriate sleeve switch that is to be sewn. This automatically sets the top feed mechanism to a zero position. The top feed mechanism is set up to have ten increments of 0–9 that varies the fullness from 0% fullness to 27% fullness in 3% increments. To achieve the desired fullness in the first part of the operation, the operator enters a top feed value from 0–9 through the key panel on the control panel 44. When a change in top feed value is desired, the operator can change this control value on the control panel. It should be understood that there can be many changes in top feed between two alignment notches and, therefore, an equivalent number of segments. After input of the new top feed setting, the top feed mechanism will automatically be set to the new value. If the top feed is changed by the operator, the program proceeds along the "Y" path to a function block 158 wherein a material multiplier (described below) is fetched.

When the jacket material changes, the amount of sleeve fullness produced at a given top feed value may change slightly. The system is operable in the automatic mode to automatically adjust the top feed values to compensate for material differences. The material type is input onto the control panel 44 if you specify the material type being sewn. Initially in the TEACH mode, a reference material such as corduroy is sewn. The parameters for a given material are input using the control panel 44 and they vary depending upon the type of material. For example, materials are divided into classifications such as a light weight woven material, a medium weight woven material, a heavy weight woven material and a medium weight knit material. Each of these material types will have a specific material multiplier associated therewith which can be stored in ROM or be input through the control panel 44 and stored in RAM. After this material multiplier is fetched, the program proceeds to a function block 160 wherein the material offset for the particular machine is fetched from memory. The material offset is determined for each machine since a program taught on one machine may be used on a different machine having slight, but important, differences in the operation thereof. After the material multiplier and the material offset have been obtained, the program proceeds to a function block 162 wherein the top feed is calculated. The top feed is calculated from the following relationship: Top Feed=-(Material Multiplier)*(Selected Top Feed+Material Offset). After the top feed is calculated, the stepper motor 82 is rotated to position reciprocating rod 43 to produce the calculated amount of top feed as indicated by function block 164.

After the top feed has been calculated for the particular material being sewn, the program proceeds to a decision block 166 to decide whether an additional stitch has been taken since the last command has been stored. If a stitch has been taken, the program proceeds along the "Y" path and if a stitch has not been taken, the program proceeds along the "N" path. Along the "Y" path, the program proceeds to a function block 168 wherein the top feed setting entered by the operator and the stitch count are stored associated with the particular segment number. The program then proceeds to a function block 170 wherein the segment number is incremented and then to a function block 172 wherein the stitch count is set equal to zero. As described above, the segment has been defined by the operator's changing of the top feed.

After the segment number has been incremented and the stitch count has been reset to zero, the program proceeds to a decision block 174 to determine if a notch switch has been depressed. The notch switch is a control on the panel 44 that determines whether an alignment notch on the sleeve is at the tip of the presser foot. If this is the case, the operator depresses the notch switch to indicate to the controller 51 that the notch is in this position. If the notch switch has been depressed, indicating that a notch is aligned with the tip of the presser foot, the program proceeds along a "Y" path to a decision block 176 to decide whether an additional stitch has been taken since the last command has been stored. If an additional stitch has been taken, the program proceeds along the "Y" path to a function block 178 wherein the top feed setting and stitch count are stored in association with the segment number. The program then proceeds to a function block 180 to increment the segment number and then to a function block 182 to reset the stitch count equal to zero. The presence of a notch at the tip of the presser foot determines the end of another segment. It is not necessary at this point for the operator to change the top feed to increment the segment number. The program then proceeds to a function block 184 to store the notch command.

After the notch command has been stored, the program proceeds to a decision block 186 to decide whether the MANUAL or the AUTO switch has been depressed. Depressing either of these switches takes the program out of the TEACH mode. If the machine remains in the TEACH mode, the program proceeds along the "N" path back to the input of the decision block 152 to complete a full loop of the program.

If the notch switch has not been depressed, indicating that the notch has not yet been aligned with the tip of the presser foot, the program proceeds from the decision block 174 along the "N" path to the input of the decision block 186. If the notch switch has been depressed but an additional stitch has not been taken since the last command was stored, the program also flows to the input of the decision block 186 from the decision block 176 along the "N" path thereof.

If the top feed does not have to be changed after a stitch has been taken, as indicated by the decision block 156, the program flows from the decision block 156 along the "N" path thereof to the input of the decision block 174 thereby bypassing the steps wherein the top feed is calculated. In addition if the top feed is calculated and an additional stitch is not taken, the program flows from the decision block 166 on the "N" path thereof to the input of the decision block 174 thereby bypassing the step of storing the top feed setting and stitch count.

In operation, the program normally follows the path through the decision block 152 to increment the stitch count in the function block 154 until either the top feed has been changed by the operator, as indicated by the decision block 156, or the notch switch has been depressed, as indicated by the decision block 174. If the operator changes the top feed by inputting a new top feed setting into the panel 44, the controller then calculates the proper top feed by taking into account the amount of offset and the material multiplier as indicated in the function block 162. If a stitch has been taken the program will then flow to the function block 168 to store the top feed setting and stitch count in association with the particular segment number and then increment the segment number.

If the operator does not change the top feed setting, the program continues to increment the stitch counter until the notch switch is depressed. At this point, the program flows along the "Y" path of the decision block 174 to store the top feed setting entered by the operator and stitch count associated with the segment number, as indicated by the function block 178. The program then resets the segment number and proceeds to the next segment number and it continues to increment stitches until either the notch switch has been depressed or the top feed has been altered. This procedure continues until the system is taken out of the TEACH mode wherein the program will flow from the decision block 186 along the "Y" path thereof to a function block 188 where the selected size and stitch length that has been sewn is stored. The program then flows to a terminating block 190 to terminate the program.

When the program is terminated, the operator then sews an additional distance to overlap and lock the seam. The thread trimmer (if present) is then activated to lift the presser foot and position the needle up. After the right sleeve has been sewn, the left body and left sleeve pieces are then placed on the machine and then the TEACH switch and LEFT SLEEVE switch are depressed thereby allowing the operator to enter the program of FIG. 7 and store the parameters for the left sleeve.

Figure 8:
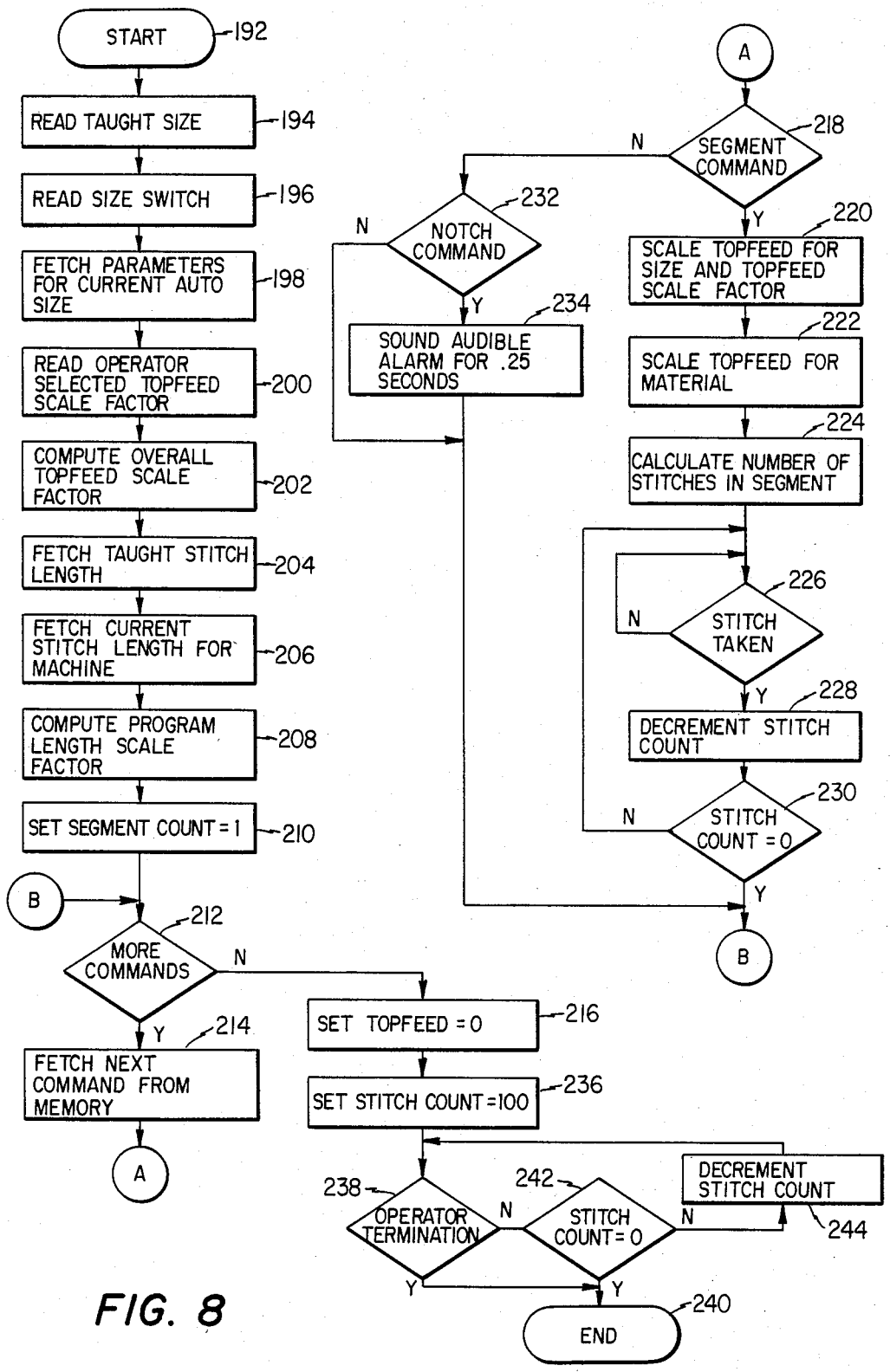
FIG. 8 illustrates a flow diagram for the semi-automatic mode of the present invention.

Referring now to FIG. 8, there is illustrated a flow chart for the semi-automatic mode of operation. To select the program, the operator sets the PROGRAM SELECT dial on the panel 44 to the desired program to correspond to the style being sewn. The MATERIAL dial is then set to the correct setting for the type of material to be sewn. The AUTO switch on the control panel 44 is then depressed to put the system into the semi-automatic mode. After the AUTO switch is depressed, a light on the panel 44 is activated indicating that the right sleeve is to be sewn. However, if the left sleeve is to be sewn first, the LEFT SLEEVE switch on the panel 44 is depressed. The right and left sleeve switches can be depressed at any time depending upon the particular sleeve to be sewn. This switch must match the sleeve being set at all times while sewing in the semi-automatic mode since the top feed control sequence is different for the right and left sleeves. The operator then sets the SIZE dial on the panel 44 to the correct size to be sewn.

The depression of the AUTO switch is indicated by a START block 192. The program then proceeds to a function block 194 wherein the taught size is read from memory. As described above, the taught size is a reference from which to adjust the parameters for the various other sizes. The program then proceeds to a function block 196 to read the SIZE switch that was set by the operator to determine the size to be sewn. It is therefore not necessary to teach the machine a particular size since the machine can adjust from any taught size to the size to be sewn.

After reading the SIZE switch, the program proceeds to a function block 198 to fetch the parameters for the current size to be sewn in the AUTO mode. These parameters are stored in a table which contains the sleeve and armhole dimensions for all sizes. After obtaining these parameters, the program proceeds to a function block 200 to read the operator selected top feed scale factor. This scale factor is unique to the particular machine and provides a method for compensating each particular machine that utilizes a taught program since all machines vary somewhat in their rate of top feed. For example, a particular machine that is set at a 12% top feed may in actuality feed at 11%, thus introducing error. Therefore, it is necessary to compensate for such variances to assure programs can be transferred from machine to machine.

After obtaining the proper parameters, the program proceeds to a function block 202 wherein the overall top feed scale factor (SCLFAC) is determined by the following relationship:

$$SCLFAC = \frac{LBT*(LSA - LBA)}{LBA*(LST - LBT)} \times (TFSCL)$$

LBT = Circumference of body armhole for taught size.

LST = Circumference of sleeve armhole for taught size.

LBA = Circumference of body armhole for auto size.

LSA = Circumference of sleeve length for auto size.

TFSCL = Topfeed scale factor.

After computing SCLFAC, the program proceeds to a function block 204 to fetch the taught stitch length (STLT) which is stored with the taught program in RAM. The stitch length of the machine on which the program was taught may vary from the stitch length of the machine on which the operation is to be performed in the AUTO mode. A stitch length scale factor is used to compensate for such variances. The program then fetches the current stitch length for the machine (STLA), as indicated by function block 206. The program stitch length scale factor (SIZCON) is then computed by the following relationship:

$$SIZCON = \frac{(STLT)\,(LBA)}{(STLA)\,(LBT)}$$

The scale factor (SIZCON) determines the scale factor for the number of stitches to be sewn as described hereinbelow. The program then proceeds to a function block 210 wherein the segment count is set equal to 1.

After computing all of these scale factors and setting the segment count equal to 1, the program proceeds to the input of a decision block 212 to decide if there are any commands stored in memory. If there are additional commands, the program proceeds along the "Y" path to a function block 214 and, if there are no more commands in memory, the program proceeds along the "N" path to a function block 216.

When there are additional commands to be carried out, the function block 214 indicates a step whereby the next command is obtained from memory. The program then proceeds to a decision block 218 to decide whether the next command is a segment command. If it is a segment command, the program proceeds along the "Y" path to function block 220 to scale the top feed by multiplying the top feed programmed by the overall top feed scaling factor (SCLFAC) to determine what the specific top feed should be for this size as compared to the taught size. The program then proceeds to the function block 222 to scale the top feed for the material type. This is accomplished by multiplying the material multiplier by the sum of the computed top feed and material offset, as described above with reference to the teaching procedure illustrated in the flow chart of FIG. 7.

After the top feed has been scaled for size and material, the program proceeds to a function block 224 wherein the number of stitches to be sewn for the particular segment are computed. This is accomplished by multiplying the stored stitch count of the taught program by the program length scale factor (SIZCON). The program then proceeds to a decision block 226 to decide if a stitch has been taken. If a stitch has not been taken, the program proceeds along the "N" path thereof to return to the input of the decision block 226. The program continues in this loop until a stitch has been taken at which time the program flows along the "Y" path to a function block 228 where the stitch count is decremented. The program then proceeds to a decision block 230 to decide if the stitch count is equal to zero. If the stitch count is not equal to zero, the program proceeds along the "N" path thereof to the input of the decision block 226 to continue taking stitches and decrementing the stitch count.

When the stitch count has reached zero, the program proceeds along the "Y" path thereof and back to the input of the decision block 212 to retrieve further commands from the RAM that were stored during the taught program. As described above, there are segment commands determined by whether the top feed has changed and notch commands determined by the presence of a notch at the tip of the presser foot during the teaching mode and the program will continue incrementing through the sequential segments. If at decision block 218 a command is not a segment command, the program flows along the "N" path of decision block 218 to a decision block 232 to decide if the command is a notch command. If it is a notch command, the program flows along the "Y" path to a decision block 234 that indicates the sounding of an audible alarm for a duration of approximately 0.25 seconds. This alarm allows the operator a means whereby she can determine if the material is being sewn at the proper rate. This is because a notch command is programmed to occur when the alignment notches are at the tip of the presser foot. By observing the alignment notches in conjunction with listening to the audible alarm, the operator can determine if the top feed is to high or too low for the particular material. At this point the operator can stop the sewing operation and resynchronize the program by sewing to the point at which the next alignment notch is at the tip of the presser foot and depressing the NOTCH switch on the panel 44. This resynchronizes the program only for the part being sewn and does not permanently modify the program. If a notch command or a segment command is not present, the program flows along the "N" path from the decision block 232 to the input of the decision block 212 to await more commands.

When all commands have been retrieved from memory for the taught program, the program proceeds from the decision block 212 along the "N" path thereof to the function block 216 wherein the top feed is set equal to zero. The program then flows to a function block 236 to set the stitch count equal to 100. The program then flows to a decision block 238 to determine if the operator has terminated the program. If the operator desires to terminate the program, the program flows along the "Y" path to the input of a terminating or "End" block 240 and, if the operator does not desire to terminate the program, the program flows from the decision block 238 along the "N" path thereof to a decision block 242 to decide if the stitch count is equal to zero. If the stitch count is not equal to zero, the program flows along the "N" path to a function block 244 where the stitch count is decremented and the program returns to the input decision block 238. When the stitch count is equal to zero, the program flows along the "Y" path of the decision block 242 to the "End" block 240. The portion of the program beginning at the function block 216 allows the operator the ability to sew a maximum of 100 additional stitches at the end of the program. In this manner, the operator can overlap and lock the seam to end the operation.

As the sleeve is being sewn, the audible alarm will be sounded at a point in which the system expects an alignment notch to be at the tip of the presser foot, as described above. For one portion, the operator can resynchronize the program by sewing to the point at which the next alignment notch is at the tip of the presser foot. However, if the system is consistently providing too much or too little top feed (all notched points are short or long) the MATERIAL control on the panel 44 is utilized to increase or decrease the top feed as required. If one particular notched point is consistently short or long, the top feed value for the individual seam segment can be increased or decreased by editing the stored program. This is accomplished by entering an edit program and inputting the desired top feed for the particular segment.

The operating instructions for a Pfaff 337 sewing machine utilizing the present inventive concept are as follows with the switches and dials noted found on panel 44 with the exception of the recorder controls.

OPERATING INSTRUCTIONS

1. If the style to be sewn has previously been programmed, skip to Step 5.
2. Determine the top feed values required to produce the desired fullness distribution in the sleeve. See Table I for instructions.
3. Program to sew the style. Refer to Table II.
4. If desired, transfer the program data to tape cassette. Refer to Table III.
5. Operate the system in the semi-automatic mode to set sleeves. Refer to Table IV. If notch alignment problems are encountered, refer to Table VII.

TABLE I

SLEEVE FULLNESS DISTRIBUTION

The present system automatically controls the variable top feed mechanism to control the sleeve fullness. The variable top feed mechanism can be manually set to 10 different positions (0 to 9) to produce approximately the following amount of fullness:

| TOPFEED VALUE | % SLEEVE FULLNESS |
|---|---|
| 0 | 0% |
| 1 | 3% |
| 2 | 6% |
| 3 | 9% |
| 4 | 12% |
| 5 | 15% |

-continued

| TOPFEED VALUE | % SLEEVE FULLNESS |
|---|---|
| 6 | 18% |
| 7 | 21% |
| 8 | 24% |
| 9 | 27% |

The top feed value is input by depressing the appropriate digit on the keypad on the Auxiliary Control Panel when the system is in the manual or programming modes (MANUAL or TEACH). When the system is operated in the semi-automatic mode (AUTO), the top feed is controlled automatically to produce the desired sleeve fullness distribution.

Each style jacket may have a different sleeve fullness distribution requirement. For example, some jackets have more fullness than others and the distribution of the fullness will vary according to the designer's specifications. Each different style should be programmed as a different program number using the PROGRAM SELECT dial on the Auxiliary Control Panel. A maximum of 8 different styles can be programmed at any one time.

Since the starting point and sewing direction may be different for the left and right sleeves, each sleeve is programmed separately. This allows complete freedom in selecting the starting point, top feed sequence and top feed values for each sleeve.

When the system is programmed, the microprocessor remembers the top feed value/stitch count sequence. For example, the top feed may be set at a value of 4 for 23 stitches, then 6 for 18 stitches, then 0 for 31 stitches, etc. When the program is subsequently repeated in the semi-automatic mode, the operator uses the PROGRAM SELECT dial to specify the style being sewn and the system automatically adjusts the top feed value/stitch count sequence accordingly.

When the jacket size changes, the system automatically adjusts the top feed value/stitch count sequence for the new size. For example, when a larger size is sewn, the number of stitches sewn at a particular top feed value will be incremented to adjust for the larger size. If necessary, the system will also adjust the top feed values to assure the correct amount of fullness is maintained over the larger distance. For example, if the total amount of sleeve fullness is the same for all sizes, the top feed values must be reduced when large sizes are sewn and increased when smaller sizes are sewn. The opertor uses the SIZE dial on the Auxiliary Control Panel to specify the size being sewn and the system automatically adjusts the top feed value/stitch count sequence accordingly. Size grading data must be input prior to using the system using the procedure outlined in Table V.

When the jacket material changes, the amount of sleeve fullness produced at a given top feed value may change slightly. If desired, the system will automatically adjust the top feed values to compensate for material differences. The MATERIAL dial on the Auxiliary Control Panel is used to specify the material type. When the material type selected in the semi-automatic mode is different from the material type selected when the system was programmed, the top feed values will be adjusted automatically to compensate for the material feeding differences. The material types are defined as follows:

0=Reference (see below)
1=Woven—Light Weight
2=Woven—Medium Weight
3=Woven—Heavy Weight
4=Knit—Medium Weight
5=Not classified at this time
6=Not classified at this time
7=Not classified at this time Material type 0 is a special material type for which no top feed value adjustments (increases or decreases) are made. Material type 0 should be used for materials such as corduroy which feed differently according to the bias angle at which the material is sewn. It is recommended that these type materials be programmed as a unique style (using the PROGRAM SELECT dial) with material type 0 selected when the style is sewn in the semi-automatic mode.

In summary, the top feed value/stitch count sequence is adjusted to maintain the proper top feed distribution for style, size and material changes as follows:

| VARIABLE | ADJUSTMENT |
|---|---|
| Style Changes | Use the PROGRAM SELECT dial to specify the style number (0 to 7) |
| Size Changes | Use the SIZE dial to specify the size (up to 14 sizes allowed) |
| Material Changes | Use the MATERIAL dial to specify the material type (0 to 7) |

TABLE II

PROGRAMMING METHOD FOR SETTING JACKET SLEEVES

The production system is programmed using the procedures outlined in Table III. The programming system is programmed by setting one left sleeve and one right sleeve using the following procedure:

1. Depress the MANUAL switch on the Operator Control Panel.
2. Set the SIZE dial on the Auxiliary Control Panel to the size to be sewn.
3. Set the PROGRAM SELECT dial to the desired program number and the MATERIAL dial to the proper material type. Refer to Table I concerning the setting of these dials.
4. Align and position the right body and right sleeve pieces under the needle and lower the presser foot.
5. Depress the TEACH switch. Depress the RIGHT SLEEVE switch. The system will automatically position the variable top feed mechanism to the zero (0) position when the TEACH switch is depressed. The left digit in the Operator Control Panel display will be set to "1" to indicate the first part of the sleeve (the first seam segment) is about to be programmed.
6. Enter the top feed value (0–9) required to achieve the desired fullness for the first part of the operation by using the keypad on the Auxiliary Control Panel. For example, if a top feed value of 3 is desired for the first portion of the sleeve, depress the 3 on the keypad. Refer to Table I for information concerning how to determine the proper top feed value. When the desired value is input via the keypad, the top feed mechanism will automatically be set accordingly and the value will be displayed using the right digit on the Operator Control Panel display.

7. Fully depress the foot treadle to begin setting the sleeve. Sew until a change is required in the top feed value or an alignement notch on the sleeve is at the tip of the presser foot. When a change in the top feed value is desired, enter the new top feed value by depressing the appropriate number (0–9) on the keypad on the Auxiliary Control Panel. The top feed mechanism will automatically be set to the new value. When an alignment notch is at the tip of the presser foot, depress the NOTCH switch on the Operator Control Panel. The seam is divided into "segments" corresponding to the alignment notches and changes in the top feed value. Depressing the NOTCH switch or changing the top feed value increments the segment number. The number of segments is essentially unlimited but only the last digit of the segment number is displayed (segment numbers 2, 12, and 22 all display only a 2).
8. Continue sewing around the sleeve, changing the top feed values and marking the alignment notch points as required.
9. When the starting point is reached, depress the MANUAL switch.
10. Sew an additional distance to overlap and lock the sewn.
11. Apply hard heel pressure to activate the thread trimmer (if present) and to lift the presser foot and position the needle up. If a thread trimmer is not present, pull the needle and bobbin thread over the knife to clip the threads. Remove the completed part.
12. Align and position the left body and left sleeve pieces under the needle and lower the presser foot.
13. Depress the TEACH switch. Depress the LEFT SLEEVE switch.
14. Repeat steps 6–11 above to set the left sleeve. Programming is completed and the system can now be operated in the semi-automatic mode using the procedure outlined in Table IV or the program data can be transferred to tape cassette by using the procedure outlined in Table III.

TABLE III

PROGRAM TRANSFER PROCEDURES

Program created on the programming system can be transferred to production systems using the procedures outlined below. To transfer a program from the memory of the programming system to tape cassette, the following procedures must be followed:

1. Depress the MANUAL mode switch. Set the PROGRAM SELECT dial to the program number to be transferred to tape.
2. Disconnect connectors J3 and J7 on the back of the controller chassis and connect the cables on the recorder into the appropriate connectors.
3. If necessary, place a piece of adhesive tape over the write lock tabs on the cassette tape to enable the system to write data onto the tape. Depress the EJECT button, place the tape in the recorder, close the lid, and rewind the tape by depressing the REWIND button. Depress the STOP button when rewinding is completed.
4. Depress the RECORD and PLAY buttons on the recorder at the same time. The recorder is now ready to accept data.
5. Enter #*7 on the keypad on the Auxiliary Control Panel. The system will write the program data to the tape. While the data is being transferred, the display on the Operator Control Panel will blink with the number "000" displayed. Data transfer is completed when the display stops blinking. Depress the STOP button.
6. After the program has been transferred to the tape, it must be verified. Depress the REWIND button. After the tape has rewound, depress the AUTO switch on the Operator Control Panel, then depress the PLAY button on the recorder and enter #*8 on the keypad. The tape will then be read and the data compared to the memory data for the program. While the data is being verified, the display will blink with "000" displayed. If an error is detected 961 or 901 will be displayed and the program transfer must be repeated. If the display remains blank beyond the point where the program should have been read, depress the MANUAL switch, rewind the tape and repeat. Depress the STOP button.
7. Depress the REWIND button on the recorder. After the tape has rewound, depress the EJECT button and remove the tape.
8. Label the cassette tape and (if desired) remove the adhesive tape or the write lock tabs to prevent accidental writing to the cassette tape.
9. Disconnect the recorder cables to connectors J3 and J7 and reconnect the system cables.

To transfer a program from tape cassette to a production system, the following procedures must be followed:

1. Depress the MANUAL mode switch. Set the PROGRAM SELECT dial to the program number to be loaded from tape.
2. Disconnect connectors J3 and J7 on the back of the controller chassis and connect the cables on the recorder into the appropriate connectors.
3. Depress the EJECT button on the recorder, place the tape into the recorder, close the lid and rewind the tape by depressing the REWIND button. Depress the STOP button.
4. Depress the PLAY button on the recorder. The recorder is now ready to transfer data to the system.
5. Enter #*8 on the keypad on the Auxiliary Control Panel. The system will read the program data from the tape. While the data is being transferred, the display on the Operator Control Panel will blink with the number "000" displayed. Data transfer is completed when the display stops blinking. If an error is encountered during the data transfer, the number 961 or 901 will be displayed and the data transfer must be repeated. If the display remains blank beyond the point where the program should have been read, depress the MANUAL switch, rewind the tape and repeat.
6. Depress the REWIND button on the recorder. After the tape has rewound, depress the EJECT button and remove the tape.
7. Disconnect the recorder from connectors J3 and J7 and reconnect the system cables.

TABLE IV

SEMI-AUTOMATIC MODE OPERATING INSTRUCTIONS

The operating instructions for the semi-automatic (AUTO) mode are as follows:

1. Set the PROGRAM SELECT dial on the Auxiliary Control panel to the desired program to correspond to the style being sewn. Set the MATE- RIAL dial to the correct setting. If a ply separator is to be used, enter *00 on the keypad.

2. Depress the AUTO switch on the Operator Control Panel. When the AUTO switch is depressed, the RIGHT SLEEVE switch light will be lit to indicate the system is ready to sew the right sleeve. If the left sleeve is to be sewn first, depress the LEFT SLEEVE switch. The RIGHT SLEEVE and LEFT SLEEVE switches can be depressed at any time. The switch selected must match the sleeve being set at all times while sewing in the AUTO mode since the top feed control sequence is different for the right and left sleeves.
3. Set the SIZE dial on the Auxiliary Control panel to the correct size to be sewn.
4. Apply heel pressure to lift the presser foot. Align and position the parts to be sewn and release the foot treadle to drop the presser foot.
5. Fully depress the foot treadle to start the operation. If the ply separator option is enabled, the system will take two switches and then stop with the presser foot up and the needle positioned down. If a ply separator is used, insert the ply separator between the sleeve and the body and release and redepress the foot treadle to continue the operation.
6. The system will automatically set the top feed to the proper value and sewing will start. As long as the foot treadle is held down, sewing will continue with the system automatically adjusting the top feed value in accordance with the top feed value/stitch count sequence previously programmed for the style and modified as required for size and material variances. When it is necessary to stop to realign the material, release the foot treadle and the machine will stop needle down. When ready to resume, simply depress the foot treadle. The material should not be "held back" but should be allowed to feed normally with the top feed mechanism adding the necessary fullness to the sleeve. However, it may be necessary to make minor adjustments by holding back the top or bottom ply to accurately align notches.
7. The operation can be terminated at any time by applying hard heel pressure. When the operation is terminated, the thread trimmer will be activated (if present), the presser foot will be lifted and the needle positioned up to allow the parts to be removed. When the operation is terminated near the end of the operation, the system will stay in the AUTO mode and automatically switch to the opposite sleeve (RIGHT to LEFT or LEFT to RIGHT). Otherwise, when the operation is terminated earlier, the system will stay in the AUTO mode but will "back up" to the prior notch point to resume when the foot treadle is depressed. The operator must rip back to the prior notch point and then resume to complete the part.
8. As the sleeve is sewn, the beeper will be sounded at the point at which the system expects an alignment notch to be at the tip of the presser foot. This allows the operator to assure the part is being sewn correctly. In the event the alignment notch has not reached the tip of the presser foot or has gone past the tip of the presser foot at the time the beeper sounds, the operator can resynchronize the program by sewing to the point at which the next alignment notch is at the tip of the presser foot and depressing the NOTCH switch on the Operator Control Panel. This resynchronizes the program only for the part being sewn and does not permanently modify the program.
9. If the system is consistently providing too much or too little top feed (all notch points are short or long), the MATERIAL dial on the Auxiliary Control Panel should be used to increase or decrease the top feed as required. If one particular notch point is consistently short or long, the top feed value for the individual seam segment should be increased or decreased using the procedure outlined in Table VI.
10. If a ply separator is used, pause approximately one inch (2.5 cm) before the seam is completed, lift the pressure foot, remove the ply separator and resume sewing.
11. Overlap and lock the seam and then apply hard heel pressure to end the operation. The thread trimmer will be activated (if present) and the presser foot and needle will be positioned up to allow the parts to be removed. The system will remain in the AUTO mode and will revert to the opposite sleeve automatically (RIGHT to LEFT or LEFT to RIGHT).
12. Repeat steps 3–11 to sew the remaining sleeves.

TABLE V

GRADING DATA INPUT PROCEDURE

The size grading data used by the system to vary the top feed value/stitch count sequence for different sizes must be input on the programming system using the following procedure:

1. Depress the MANUAL switch on the Operator Control Panel.
2. Enter *#0 on the keypad on the Auxiliary Control Panel.
3. Set the SIZE dial on the Auxiliary Control Panel to the size for which data is to be input.
4. Enter a 3 digit number (001–999) on the keypad corresponding to the dimension of the sleeve opening in the body parts for the size. For example, if the dimension of the sleeve opening is 22.5 inches (57.1 cm) then enter 225 (or 571) on the keypad. The value input will be displayed in the Operator Control Panel display.
5. Repeat steps 3 and 4 for all sizes.
6. Enter *#2 to terminate. If the sleeve fullness is constant for all sizes (for example, if the sleeve cap dimension is 1.75 inches larger than the sleeve opening in the body parts for all sizes) no additional data is required. Otherwise, the sleeve cap dimension for each size must also be input so that the system can adjust the top feed value/stitch count sequence as required. To enter the sleeve cap dimensions, follow the procedure outlined above except enter *#8 in step 2 in lieu of *#0.

If the size range and/or grading data changes, the new data must be input using the above procedure. Size grading data is transferred automatically via the tape cassette to the production system.

TABLE VI

TOPFEED VALUE EDITING PROCEDURE

The top feed values for individual seam segments on the left or right sleeve can be edited using the following procedure:

1. Set the PROGRAM SELECT dial to the program number to edit.
2. Enter #0 on the keypad.
3. Depress the LEFT SLEEVE or RIGHT SLEEVE switch to indicate which sleeve to edit.
4. The top feed value for the first segment will be displayed. If the value is to be changed, enter the new value (0–9) desired. Otherwise, enter # on the keypad to increment to the next segment or enter * to decrement to the prior segment.
5. Depress the MANUAL switch to abort the edit mode. Otherwise, the system will terminate the editing mode automatically after the last segment is displayed.

TABLE VII

ACCURACY CONSIDERATIONS

Dimensional variances in the sleeve and body parts due to cutting and assembly errors may cause minor accuracy problems. Note: These variances also cause problems when setting sleeves manually. The body normally consists of a front, side-body and back and the sleeve consists of a top sleeve and under sleeve. Three seams are used to join the body parts and two seams are used to join the sleeve parts. Assuming each joining operation has an accuracy tolerance of 1/16 inch (1.5 mm), the maximum dimensional variances due to seaming inaccuracies is $\frac{3}{8}$ inch (9 mm) in the body and $\frac{1}{4}$ inch (6 mm) in the sleeve (the inaccuracy for each seam is twice the tolerance). The worse case is for the body to be at one extreme ($\frac{3}{8}$ inch larger or $\frac{3}{8}$ inch smaller than nominal) and the sleeve to be at the opposite extreme ($\frac{1}{4}$ inch smaller or $\frac{1}{4}$ inch larger than nominal). In such cases, the maximum total dimensional variance due to assembly errors can be $\frac{5}{8}$ inch (15 mm) with the result that the fullnes is increased or decreased by that amount. Cutting errors can be of any magnitude and must be controlled closely if acceptable results are to be obtained in the sleeve set operation—manually or semi-automatically. Statistically, the dimensional variances cancel each other the majority of the time and only a small percentage of the parts should require significant alignment by the operator to correct such assembly variances.

In addition to cutting and assembly variances, a style programmed on one machine may need to be edited slightly to run on another machine or to sew a different material. All machines must be set up to produce no fullness when the top feed value is set to 0 in the MANUAL mode to assure a common reference point. The top feed values for the entire operation can be increased or decreased to compensate for feeding differences. Enter *7 on the keypad and the current top feed scaling factor will be displayed. If more top feed is required, enter a three digit number larger than the displayed value and vice versa. For example, if the value is 1.00 and 110 is entered, the top feed is increased by 10% for the entire operation.

Since the stitch length may vary slightly from machine to machine, the notch points indicated by the buzzer may differ slightly. The system will automatically compensate for stitch length variances if desired. If the notch buzzer is sounding before the notch points are reached, the stitch length is shorter than the stitch length on the machine on which the operation was programmed. Likewise, if the notch buzzer is sounding late, the stitch length is longer. Stitch length data for the machine can be input by entering *8 on the keypad followed by three digits representing the stitch length. For example entering *8 and then 220 will specify a stitch length of 2.20 mm. When the *8 is entered, the stitch length for the programmed data is displayed. If the notch buzzer is sounding early, enter a smaller value and vice versa.

The system will produce repeatable results on consistent parts and material. In practice, the variances described above can easily be controlled by the operator slightly retarding the feed of the sleeve or the body to match alignment notches.

TABLE VIII

KEYPAD ENTRIES

The folloing entries on the Auxiliary Control Panel keypad are used to set up the system parameters.

| KEYPAD ENTRY | FUNCTION |
|---|---|
| *00 | Select ply separator mode. |
| *01 | Disable ply separator mode. |
| *7 | Set top feed scaling factor. Enter three digits for the new value (x.xx) |
| *8 | Set stitch length factor. Enter three digits for the new value (x.xx) |
| *#0 | Enter body length data. See Table V. |
| *#8 | Enter sleeve length data. See Table V |

In summary, there has been provided a semiautomatic sewing machine that is utilized to sew a jacket sleeve into an armhole utilizing predetermined parameters stored in a microprocessor memory to provide the proper fullness distribution in the assembled garment. The sewing machine utilizes a variable top feed mechanism which is controlled by a microprocessor to achieve the desired fullness distribution in the sleeve relative to the body of the jacket. The predetermined parameters comprise the top feed mechanism settings required for multiple stitch counted intervals along the periphery of the armhole. The system is programmed for a particular size, style and material when a skilled operator sews a first garment. Subsequently, the system repeats the operation in a semi-automatic mode wherein the operator simply guides the parts while the microprocessor controls the top feed mechanism to achieve the proper fullness distribution for all sizes and material variances of the same style. The capability to adjust the programmed parameters to compensate for left and right sleeves, machine feeding variances and stitch length variances is also included.

Although the preferred embodiment has been described in detail, it should be understood that the various changes, substitutions, and alterations, can be made therein without departing from the spirit and scope of the invention as defined by the appended claims.

What I claim is:

1. A method for stitching pieces of material together with a specified fullness distribution for a plurality of different sizes and styles of a garment comprising:

storing first information regarding the number of stitches defining the length of differential feed zones for a specific garment size or style;

storing second information regarding the magnitude of differential feed for each differential feed zone for said specific garment size or style;

storing third information relating to variations in the number of stitches defining the length of differential feed zones for a plurality of different garment sizes or styles;

storing fourth information relating to variations in the magnitude of differential feed rates for a plurality of different garment sizes or styles;

sensing the stitch count of the material being sewn; and automatically adjusting the magnitude of the differential feed and length of the differential feed zones of said material being sewn in dependence upon said stitch count and said first, second, third and fourth stored information, wherein different fullness distribution is automatically provided to a plurality of different garment sizes or styles being sewn.

2. The method of claim 1 wherein the step of adjusting the magnitude comprises adjusting the feed rate of only one of the pieces of material relative to the other piece of material.

3. The method of claim 1 wherein one of said pieces of material comprises a sleeve edge and the other end of said pieces of material comprises an armhole in a jacket.

4. The method of claim 1 wherein said steps of storing said first and second information are accomplished by manually sewing a garment having the desired fullness.

5. Apparatus for stitching pieces of material together with a specified fullness distribution for a plurality of different sizes and styles of a garment comprising:

first means for storing information regarding the number of stitches defining the length of differential feed zones for a garment size or style;

second means for storing second information regarding the magnitude of differential feed for each differential feed zone for said garment size or style;

third means for storing information relating to variations in the length of differential feed zones for a plurality of different garment sizes or styles;

fourth means for storing information relating to variations in the magnitude of differential feed rates for a plurality of different garment sizes and styles; and means for automatically adjusting the magnitude of the differential feed and length of the differential feed zones of material being sewn in dependence upon said stored information in said first, second, third and fourth means for storing, wherein different fullness distribution is automatically provided to different garment sizes or styles being sewn.

6. The apparatus of claim 5 wherein said means for adjusting comprises:

a first feed dog having a variable rate for advancing one of the pieces of material to be sewn; and a second feed dog having a controllable rate for advancing the remaining piece of material to be sewn;

the feed rate for said second feed dog independently adjustable of said first feed dog to provide a varying relative feed rate therebetween.

7. The apparatus of claim 5 wherein said first and second means for storing comprises a random access memory.

8. The apparatus of claim 9 wherein said means for accessing comprises a central processing unit.

9. The apparatus of claim 5 wherein said means for automatically adjusting comprises:

means for accessing said stored information; and means responsive to said accessed stored information for adjusting the magnitude and length as a function of stitches per unit distance.

10. The apparatus of claim 5 wherein said means for adjusting further comprises means for sensing the stitch count of the material being sewn.

11. The apparatus of claim 5 wherein information is stored in said first and second means by manually sewing material with desired fullness for a garment with a desired size and style.

* * * * *